United States Patent [19]

Amabili

[11] 4,122,970

[45] Oct. 31, 1978

[54] TAMPER-PROOF CONTAINER WITH ATTACHED END CLOSURE

[76] Inventor: Arnaldo Amabili, 7680 Dollier St., St. Leonard, Quebec, Canada

[21] Appl. No.: 861,664

[22] Filed: Dec. 19, 1977

Related U.S. Application Data

[63] Continuation-in-part of Ser. No. 778,175, Mar. 16, 1977, abandoned, which is a continuation-in-part of Ser. No. 749,622, Dec. 13, 1976, abandoned, which is a continuation-in-part of Ser. No. 738,078, Nov. 2, 1976, abandoned.

[51] Int. Cl.[2] ..... B65D 51/18

[52] U.S. Cl. ..... 220/256; 220/259; 220/260; 220/269; 220/270; 220/336; 229/7 R; 222/541

[58] Field of Search ..... 220/256–258, 220/259, 260, 268–271, 336; 229/7 R; 222/541, 548

[56] References Cited

U.S. PATENT DOCUMENTS

| | | | |
|---|---|---|---|
| 2,813,000 | 5/1974 | Underwood | 220/269 |
| 3,708,091 | 1/1973 | Douty | 220/336 X |
| 3,915,333 | 10/1975 | Peyser et al. | 220/268 |

*Primary Examiner*—George T. Hall

*Attorney, Agent, or Firm*—McFadden, Fincham & Co.

[57] ABSTRACT

There is provided a closure member for containers in which the closure member includes a closure wall, an aperture in the wall for dispensing a commodity through the closure member from the container, and a pair of cooperating tabs, one of which is adapted to be positioned exteriorly of the closure wall and the other interiorly in registry with each other. The outer closure member includes a movable gripping portion. The two tabs are joined together for movement about a fixed axis so as to go into and out of registry with the aperture; the inner tab is made of at least partially flexible material to permit inward bending into the body of a container to rupture a flexible inner sealing membrane. The improved closure device finds use in containers of different types and provides for an improved resistivity against tampering.

23 Claims, 34 Drawing Figures

FIG. 1
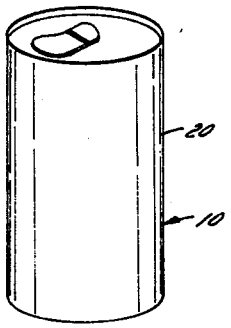
FIG. 2
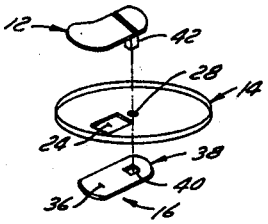
FIG. 3
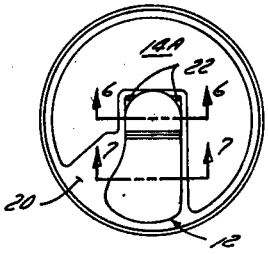
FIG. 5
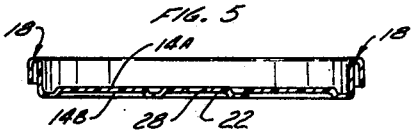
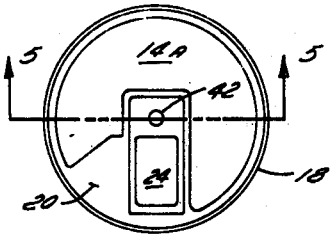
FIG. 4
FIG. 6
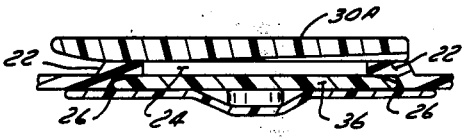
FIG. 7
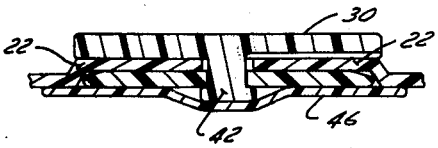
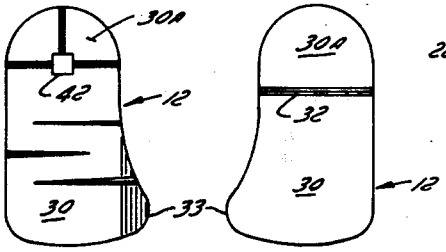
FIG. 8

FIG. 28
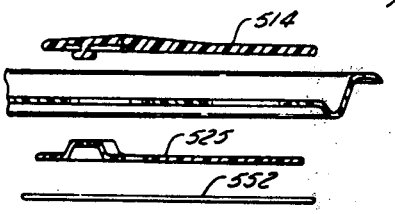
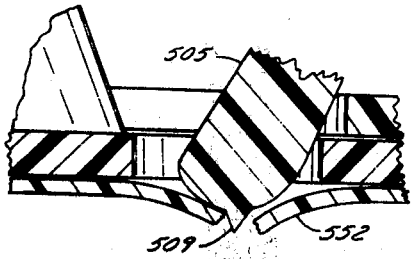
FIG. 30
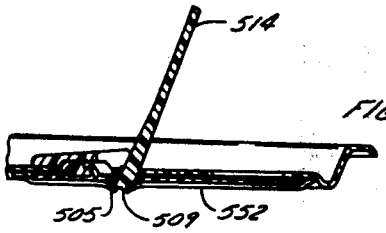
FIG. 29

TAMPER-PROOF CONTAINER WITH ATTACHED END CLOSURE

The present application is a continuation-in-part of U.S. patent application Ser. No. 778,175 filed Mar. 16, 1977 now abandoned, which is a continuation-in-part of U.S. patent application Ser. No. 749,622 filed Dec. 13, 1976 now abandoned, which is a continuation-in-part of patent application Ser. No. 738,078 filed Nov. 2, 1976, now abandoned.

This invention relates to containers.

More particularly, this invention relates to improvements in container closure means of the type where an aperture is provided in a container wall for dispensing a commodity from a container body through the aperture.

There are many different versions of container closure means with integral opening devices for permitting access to the contents of a container. Typical of such arrangements known in the prior art are those represented by U.S. Pat. Nos. 3,420,398 of Jan. 7, 1969 and 3,908,856.

The opening means in a container wall which are most popular for usage in commercial packaging are those which may be removed from the container, such as tear-off or tear-out closures. However, resistance to the use of this type of throw-away closure or opening means is increasing due to pollution requirements and moreover, because most users separate the opening/closure member completely from the container. If such closure members are made of metal, or even various types of plastic material, they pose a hazard to other parties due to the possibility of cutting or the like.

The above patents disclose opening or closure means for a container which are adapted to be retained integrally with the container after the container has been opened. However, they are relatively complicated in terms of the components required and the number of steps involved in manufacturing closure members of that nature.

There is thus a demand today for closure members which are of a relatively simple construction, which remain integral with the container with which they are associated after the closure members are opened to provide access to the contents of the container and which, further, decrease the chances of pilfering or tampering with the contents of a container. Such closure members find application for various types of containers in different arts such as for liquids, and particularly beverages, or other types of products such as granular products.

With this invention, applicant has developed an improved closure device for containers of the type which is capable of being retained as an integral component of the container, and which is of a relatively simple and economical nature and which at the same time, will tend to reduce the tampering or pilfering with the contents of a container.

More particularly, in one aspect of the invention, there is provided a container closure device comprising a closure member having a pair of opposed wall sections one of which is adapted to constitute an exterior wall section for said closure member and the other of which is adapted to constitute an interior wall section for the closure member, said closure member having a first aperture therein adapted to permit dispensing of a commodity from a container on which the closure member may be mounted, a second aperture in said closure member located in a spaced-apart operative relationship to said first-mentioned aperture, an outer closure tab adapted to surround and close said first-mentioned aperture on the exterior surface of said closure member, said outer closure tab including a finger-engaging portion and a mounting portion, an inner closure tab adapted to be located in juxtaposition with the interior wall of said closure member, said inner closure tab having a body portion adapted to surround in closing relationship said first-mentioned aperture of said closure member, means for mounting said outer closure tab and said inner closure tab in spaced-apart fixed relationship to each other through said second aperture of said closure member for movement about a fixed axis, whereby said outer and inner closure tabs may be rotated about said fixed axis for bringing said closure tabs into and out of closing relationship with said first-mentioned aperture of said closure member.

The present invention also provides an improvement in a closure device for a container. In this embodiment, and more specifically, in a closure device for a container in which the closure member has a pair of opposed wall sections one of which is adapted to constitute an exterior wall section for said closure member and the other of which is adapted to constitute an interior wall section for the closure member, and with the closure member having a dispensing aperture therein adapted to permit dispensing of a commodity from a container on which the closure member may be mounted, there is provided the improvement wherein the closure member has an outer closure tab adapted to surround and close said closure member, said outer closure tab including a finger-engaging portion and a mounting portion, an inner closure tab adapted to be located in juxtaposition with the interior wall of said closure member, said inner closure tab having a body portion adapted to surround in closing relationship said first-mentioned aperture of said closure member and means for mounting said outer closure tab and said inner closure tab in spaced-apart fixed relationship to each other for movement about a fixed axis, whereby said outer and inner closure tabs may be rotated about said fixed axis for bringing said closure tabs into and out of closing relationship with said dispensing aperture of said closure member.

In a preferred embodiment of the present invention, the closure device outlined above may be used in conjunction with a sealing member located on the interior wall section of the closure member for providing a totally seal-proof device. In still further embodiments, the closure member includes an exterior surface which includes a recessed portion and within the recessed portion, a raised land portion therein containing the first and second-mentioned apertures. Still further, a further embodiment of the present invention is where the interior wall section of the closure member includes a seating area for the interior closure tab surrounding the first and second-mentioned apertures and additionally, preferably includes a further planar surface located at a higher plane of the interior wall section.

The closure member of the present invention may be utilized in containers as either an end closure section for a container of the type which is used for beverages or frozen juices or the like; or alternately, the end closure member may be incorporated directly into one wall of a container such as a side wall of, e.g., box containers or the like. The particular configuration of the closure member is not critical and as such, the opposed wall sections of the closure member may form the wall sections of the container and thus be integral with the same; alternately, the closure member may constitute a separate entity which is incorporated into the wall sections of the container.

In the closure member of the present invention, the dispensing aperture for a commodity to be dispensed from a container may be any suitable aperture sized or dimensioned for the purpose intended. Thus, the aperture will vary depending on whether the product is granular, liquid or the like. Typical configurations include slots, elongated apertures or "tear-shaped" openings.

In accordance with this invention, the dispensing aperture is sealed or closed by means of a pair of spaced-apart cooperating closure tabs, one of which is located exteriorly of the closure wall and the other of which is located interiorly thereof. These cooperating tabs are adapted to be mounted in a fixed relationship relative to each other, and in registry with each other so that when both the outer and inner closure tabs are in registry, both function to close or seal the dispensing opening of the closure wall. Likewise, when one tab is rotated, the other tab is likewise rotated so as to permit a commodity to be dispensed from a container body. To this end, the outer and inner closure tabs are preferably dimensioned so as to each seal or close the dispensing aperture but in some cases, either one, but not both, of the tabs may be slightly smaller than the opening if this is so desired for any specialized packaging. In the preferred embodiment, the tabs surround and project slightly beyond the dispensing opening so as to provide a positive closure.

In order to provide the spaced-apart relationship between the outer and inner closure tabs, and for permitting these tabs to rotate about a fixed axis, there is provided means extending between the exterior and interior surfaces of the closure wall for fixedly securing each of the closure tabs to each other in a fixed relationship. For this purpose, suitable pivot means may be provided which extend through a further aperture in the closure wall and which pivot means are fixedly secured to each of the inner and outer closure tabs. In this manner, the inner and outer tabs may be rotated about a fixed axis into and out of closing engagement with the dispensing opening. A particularly preferred form of this embodiment includes a second aperture in the closure wall spaced apart from the first dispensing aperture but located relative thereto to define an operative relationship with the first-mentioned aperture. An inflexible or rigid ligament, post or the like, may be provided connected to the respective tabs to secure the same together in a rigid manner. In various embodiments, the ligament or post may form an integral part of either of the inner or outer tabs and may be secured by means of adhesive, heat sealing or welding depending on the type of material employed, to the other of the tabs. Still further, another embodiment includes the arrangement where one of the tabs is provided with a fixed projection extending therefrom of a length sufficient for the purposes intended which may be fixedly secured by adhesive or the like to the other tab or alternatively, the last-mentioned tab may be provided with an aperture therein which "keys" the ligament or projection from the [illegible]her member. In this configuration, the proje[illegible]ding from one member will have a [illegible]han a circular configuration with a [illegible]e sized to receive the projection in the opposed member so that both may be rotated about a fixed axis upon rotation of one of the members.

The outer closure tab preferably includes a finger-engaging portion which portion is adapted to surround the dispensing aperture and which is connected to a further portion which mounts or connects the outer tab to the inner closure tab. Between the two portions, there may be provided a score line or other line to permit the finger-engaging portion to be lifted about an axis of the body to initiate the opening action of the closure member, as described hereinafter. The score line must not be deep enough to permit separation of the finger-engaging portion from the balance of the outer closure tab and thus, the score line is not of a type which will permit separation of the finger-engaging tab from the balance of the body. In fact, depending on the type of material from which the outer closure tab is made, no score line need be provided in the case of various plastic materials where the materials permit the finger-engaging portion to be flexibly moved relative to the balance of the body of the tab.

In the embodiment described above wherein the exterior wall section of the closure member includes a raised land portion in which the dispensing aperture is located, the outer closure tab is preferably mounted in juxtaposition to the raised land portion to provide clearance of the outer tab relative to the balance of the exterior wall section. Thus, this raised land portion is preferably at least as high as, or higher than, the surrounding planar wall sections of the exterior wall. It will be appreciated, however, that if the closure member of the present invention is mounted as a portion of a cylindrical wall, this need not be the case since the curvature of the container wall will provide the necessary clearance for movement of the outer closure tab. In those cases where a raised land portion is provided for mounting the outer closure tab, a simple expedient merely involves the embossing of the wall in the area desired outwardly of the surrounding planar wall or in other cases, and particularly in the case of molded closure walls, additional material may be employed to provide the raised land portion.

With respect to the inner closure tab, a particularly preferred embodiment is where the inner wall section includes a seat for the inner wall tab. To this end, the inner wall surface may include a raised land portion surrounding the dispensing aperture of the closure member and defining therebetween a seat dimensioned to receive the inner closure tab. Conversely, the inner wall section may be provided with a recess likewise dimensioned in lieu of a raised land portion. By providing a seat in which the inner closure tab is adapted to fit, a "locking" engagement may be obtained for the cooperating inner and outer closure tabs. The inner closure tab is preferably made of a somewhat flexible material to permit at least that portion of the closure tab in registry with the dispensing aperture to be depressed from closing engagement with the dispensing aperture, as described hereinafter in greater detail. Still further, when employing the embodiment wherein a seating arrangement for the inner tab is provided, there may also be provided a raised land portion adjacent the seat and in the direction in which the closure tabs are adapted to rotate so as to provide a bearing surface against which the inner tab may rotate. This, however, is not essential and suitable devices may be provided without this feature.

In a preferred embodiment, the inner closure tab includes a pressure relief aperture adapted to be sealed by an aperture sealing member. The pressure relief aperture may be located proximate the outer extremity of the inner tab such that when the inner tab is depressed, the pressure relief aperture is opened to relieve pressure in a pressurized container. The aperture sealing member may have a raised portion with a flange extending thereabout adapted to seat on the underside of the inner tab, the raised portion extending above the plane of the inner closure tab. The aperture sealing member is hinged to the inner closure tab by suitable means as will be discussed in greater detail hereinafter.

In a further embodiment of the above, the pressure relief aperture is located within the inner closure tab proximate to the point at which the inner tab is pivoted. Operating in conjunction with the pressure relief aperture is an opening member formed integrally with the outer tab as will be discussed in greater detail hereinafter.

Depending on the type of container with which the closure device of the present invention is adapted to be used in conjunction, a suitable sealing member may be provided to surround and totally enclose the lower closure member, including the aperture closing member. Thus, in the case of commodities under pressure, or for contamination prevention, a thin rupturable sealing member may be secured to the interior wall of the closure member. This rupturable member may be made of any suitable material such as plastic, regenerated cellophane or other like substances.

The closure member of the present invention can be made of any suitable material again depending on the type of container which it is adapted to be applied to or incorporated into. Thus, for example, various types of metals are currently used in various arts and such substances include aluminum, tin, steel, or the like. In recent times, however, more popular container substances are plastic based and thus, the various components of the present invention can be made of suitable plastic materials, the choice of which will be within the skill of those skilled in this art. The closure member, is made of metal or plastic, may be molded as a one-piece entity with the outer closure tab and the connecting means between the two tabs being molded as an integral unit. In other cases, it may be desirable to form a portion of the closure device from one material, e.g. metal and utilize plastic material for other components.

The closure device of the present invention, for use in containers, operates on the principle of permitting a user to grasp the finger-engaging portion of the outer closure tab and thus, lift the same to expose the dispensing opening for the container. Thereafter, the user may depress the inner closure member and at the same time, if a rupturable membrane is employed, to rupture the same and thus permit access to the contents of the container. In the embodiment wherein a pressure relief aperture and aperture closing member is employed, when the user depresses the inner closure member, it will break the rupturable membrane releasing pressure within the container and allowing the inner closure tab to be more easily depressed. To permit the contents to be discharged from the container, the outer closure tab may thus be rotated (with the inner tab) about the fixed axis and upon rotation, the complete dispensing opening will be exposed. If re-closure is desired, depending on multiple use containers, the closure members may be rotated back into closing position and depending on the type of material employed, if the closure members are made of a material which returns to its original state, the dispensing opening may be re-closed. When a rupturable membrane is employed, and if the latter is mounted in a "taut" manner, upon rotation of the inner tab, the membrane will be ruptured or torn away by the rotational movement of the tab.

The closure member of the present invention provides a very simple closure member for containers and which requires very few parts or very few special construction features compared to prior art proposals. Subsequent to opening, the closure member remains an integral part of the container to which the closure member is attached and thus, is not separately discarded to cause a potential hazard. Still further, the closure member provides an improved tamper-proof closure member for containers in that the possibility of loss due to pilfering from a container is reduced. If any pilfering occurs from the container, there will be visual evidence of the same, particularly in the case where a rupturable membrane is employed and where the membrane is ruptured by the downward depression of the inner closure tab, and/or the aperture closing member. Thus, it is possible to visually inspect containers to ensure that they have not been tampered with prior to use or sale of the containers. The closure member of the present invention finds wide application in various arts and it may be used as a closure member for beverages, for packaging commodities such as soaps or the like.

Having thus generally described the invention, reference will now be made to the accompanying drawings illustrating preferred embodiments and in which:

FIG. 1 is a perspective view of a container embodying the present invention;

FIG. 2 is an exploded view of a closure member embodying the present invention;

FIG. 3 is a top plan view of the closure member;

FIG. 4 is a plan view of the closure member of FIG. 3 showing the inner tab;

FIG. 5 is a section taken along the line 5—5 of FIG. 4;

FIG. 6 is a section taken along the line 6—6 of FIG. 3;

FIG. 7 is a section taken along the line 7—7 of FIG. 3;

FIG. 8 illustrates the outer closure tab in top and bottom plan views;

FIG. 28 is a cross-sectional view illustrating the various components is a dis-assembled condition of a further embodiment of a can cover;

FIG. 29 is a cross-sectional view illustrating the operation of the embodiment of FIG. 28; and FIG. 30 is a detailed sectional view of a portion of the can cover of FIG. 29.

Figure 12A:
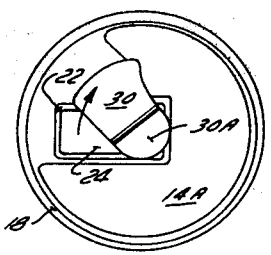
FIGS. 12A and 12B illustrate the last step in the sequence in which the outer and inner closure tabs are rotated or pivoted about the pivot point.
Figure 11A:
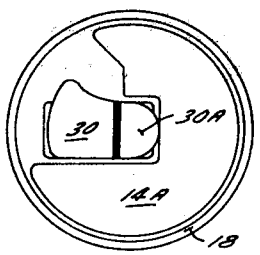
FIGS. 11A and 11B illustrates the next step in the sequence of opening a closure member in which, following the lifting of the outer tab, the inner tab is downwardly pushed to rupture a seal.
Figure 10A:
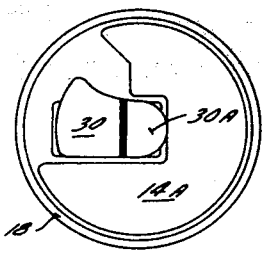
FIGS. 10A and 10B illustrate, in top plan view and in a side elevational view, the position of the outer closure tab in the first step of gaining access to a container on which the closure member is located.

Referring now in greater detail to the drawings, FIG. 1 illustrates a typical container with which the closure member of the present invention is adapted to be used in conjunction, which container is indicated generally by reference numeral 10. The container per se may be any suitable type used in various arts and there is no criticality in the type of container per se. In the embodiment illustrated, the closure member of the present invention is shown as being located on one end of the container; however, as explained herein, the closure member may be located in any suitable wall and need not form the end closure of a container. For most purposes, such as for containers retaining liquids, the container will be of a generally cylindrical nature and the closure member may be advantageously incorporated into one end of the container as shown in FIG. 1. As such, the drawings illustrate the closure member in the form of an end closure for such a container and will be described as such — it will be understood that the invention is not restricted to the particular or specific embodiments shown.

Referring to FIG. 2, the major components of the device of the present invention are illustrated and comprise an outer gripping tab indicated generally by reference numeral 12; a closure member 14 and an inner closing tab 16.

The closure member 14 includes a pair of opposed wall surfaces, one of which is adapted to be located exteriorly of a container embodying the closure device and the other which is adapted to be located interiorly of the closure device. Such surfaces are indicated by reference numerals 14*a* and 14*b* in general. The closure member, since it is in the form of an end closure for a container, includes a lip portion 18 forming a generally U-shaped member adapted to suitably engage side walls 20 of a container in the U-shaped channel.

The major portion of the surface 14*a* comprises a generally planar surface; however, the surface 14*a* includes a recessed portion therein indicated generally by reference numeral 20, and which in itself, forms a generally planar surface spaced from the surface 14*a* by, e.g. 1/16th to 3/16th of an inch. In the area of the recessed surface 20, there is provided a raised land portion indicated generally by reference numeral 22 which advantageously is of a generally planar configuration and has a level substantially the same as that of surface 14*a*. The land portion 22 is provided with an aperture 24 extending between the surfaces 14*a* and 14*b* and is adapted to permit a commodity to be discharged from the container 10. The aperture 24 may be suitably dimensioned for the type of commodity and as such, the size and configuration may vary.

On the interior surface 14*b* of the closure member, there is provided a recess therein which recess is indicated by reference numeral 26. In the embodiment shown, the recess corresponds generally in depth to the raised land portion 22 inasmuch as it is the obverse of the land 22; however, it will be understood that the recess may be separately formed in the closure member 14 if thicker materials are employed. Recess 26 is generally coextensive with the land portion 22 and thus the aperture 24 is located in the recess 26. Located within the recess 26, and correspondingly, within the raised land portion 22, is a further aperture 28, the purpose of which will be explained hereinafter.

The outer closure tab, illustrated in greater detail in FIG. 8, comprises a body portion 30 suitably dimensioned to cover the aperture 24 on the exterior surface 14A of the closure member. The body portion 13 preferably extends and surrounds the aperture 24 to overlie the same and surround the aperture 24. The body portion 30 includes an end portion 30A and separating the two, there is provided a score line 32 in the top surface of the tab 18 to provide a line of demarcation about which the tab 18 may be flexed. The line 32 can comprise a score line or the like but the material is only scored to a depth sufficient to permit the lifting of the body portion 30 upwardly from the surface 14A of the closure member without severing or breaking from the portion 30A. Thus, the score line 32 does not extend through the tab 18. Further, the body portion 30 may be suitably contoured to any desired shape and for example a projection 33 may be provided for facilitating gripping of the body portion 30 during the opening of the closure tab.

Cooperating with the outer closure tab 12 is the inner closure tab 16. The inner closure tab 16 includes a body portion 36 which is adapted to surround the aperture 24 in a sealing or closing manner. To this end, a preferred configuration is where the inner tab 16 seats on the recess 26 adjacent the aperture 24 and is in face-to-face relationship with the inner surface of the land 22. The tab 16 includes a further portion indicated generally by reference numeral 38 which includes therein an aperture 40 adapted to be placed in registry with the aperture 28 of the closure member 14, explained hereinafter in greater detail.

To permit rotation of the outer tab and the inner tab together, the two are joined in fixed relationship and to this end, a ligament or other like member, indicated by reference numeral 42, is provided to join the two together. In the embodiment illustrated, ligament 42 has a generally rectangular shape and is fixedly secured to the outer tab 12 and is integral therewith. The aperture 40 of the tab 16 is of a like rectangular shape dimensioned to receive the ligament 40 and the latter "keys" the same so that the outer and inner tabs 12 and 16 rotate simultaneously about a fixed axis. In this respect, the inner tab 16 may be fixedly secured to the ligament 40 by suitable means — e.g. adhesive, heat sealing (in the case of plastics or the like), etc.

Late in the rotation of the inner tab 16, the sides of the recess 26 may be tapered as illustrated in FIGS. 6 and 7 and in a like manner, the lateral edges of the inner tab may be bevelled to facilitate its rotation out of the recess.

In the embodiment illustrated, there is also provided a thin rupturable membrane 46 which completely seals the area of the inner closure wall containing the closure device of this invention. This membrane 46 may be adhesively or otherwise secured to the inner wall **14*b* of the closure member and as explained hereinafter, will rupture upon depressing the inner closure member 16**.

Figure 9A:
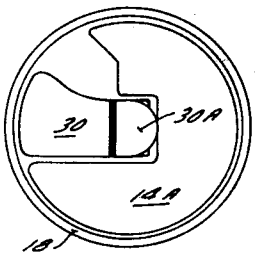
FIGS. 9A and 9B show the closure member in a top plan view in a closed position and a vertical side elevation in section of the closure member when it is in the position as indicated in FIG. 9A.
Figure 12B:
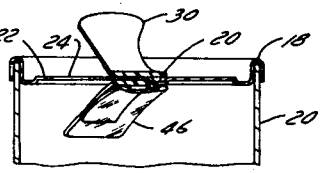
Figure 11B:
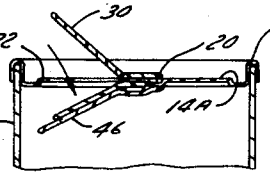
Figure 10B:
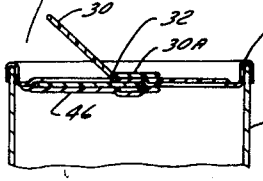
Figure 9B:
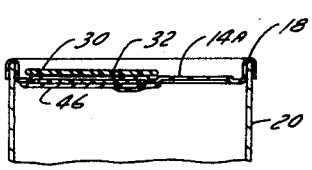

The operation of the closure member of the present invention is shown in FIGS. 9A to 12A and initially, reference will be made to FIGS. 9A and 9B illustrating the form of the closure invention as it would be located in a container in a "closed" condition. Thus, as illustrated, the rupturable membrane is located about the closure member to completely seal the closure member with the inner closure tab being located in the recess and the outer closure member in a closing relationship to the dispensing aperture 24. In the initial step of opening the dispensing aperture, the gripping portion 30 of the tab 16 is pulled upwardly (FIG. 10B) about the score line 32. In this manner, the aperture 24 is exposed. Subsequently, the inner tab 16 is depressed through a user's finger or by projecting a suitable article through the aperture 24, as illustrated in FIG. 11B, whereby the membrane 46 is either torn away from the interior wall of the closure member or is ruptured, depending on the type of material and how the membrane is secured to the inner wall. Thereafter, by gripping tab 30, as illustrated in FIG. 12, the tab is rotated about a fixed axis whereby the inner tab 16 is likewise rotated to e.g. 90° to permit complete access to the container contents through the aperture 24.

Figure 13:
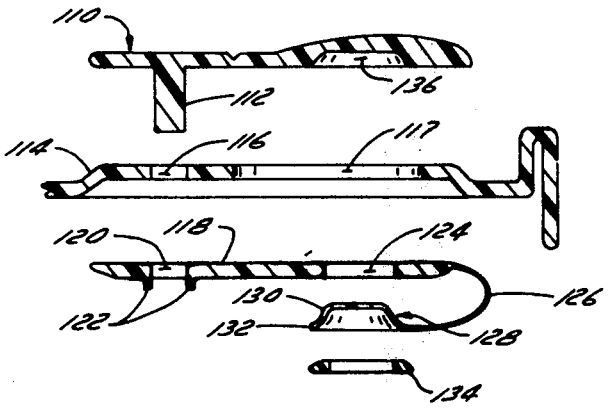
FIG. 13 is an exploded side sectional view of a further embodiment of a closure means suitable for use with pressurized containers.
Figure 14:
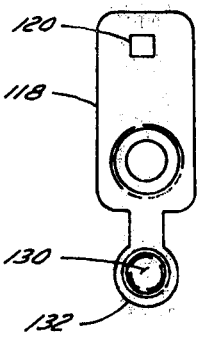
FIG. 14 is a top plan view of the inner closure member of FIG. 13.

Turning to the embodiments of FIGS. 13 and 14, the closure means comprises a closure member 114, a top gripping tab 110 having a stud 112 formed integrally therewith, and a bottom closure tab 118. Closure member 114 includes an aperture 116 adapted to receive stud 112 as described in the previous embodiment.

Bottom closure tab 118 includes an aperture 120 adapted to receive stud 112; aperture 120 may be formed by punching the same leaving a rim 122 thereabout.

In this embodiment of the invention, a pressure relief aperture 124 is provided which is in registry with dispensing aperture 117. Secured to one end of bottom closure tab 118 is a pressure relief aperture closing member 128 which includes a raised portion 130 having a flange 132 thereabout. Member 128 is connected to tab 118 by portion 126.

The closure means of FIGS. 13 and 14 operates substantially the same as those previously illustrated; when bottom tab 118 is depressed, the initial depression opens aperture 124 to relieve any pressure in the container thus facilitating the further depression of tab 118. In this respect, there may be provided a sealing membrane 134 around flange 132 where it seats on the underside of tab 118. Sealing membrane 134 may, in reality, be the same membrane as is provided about tab 124. It will be noted that aperture closing member 128 has a raised portion 130 as aforementioned; to receive this raised portion, there may be provided a cavity 136 in top gripping member 110.

Figure 15:
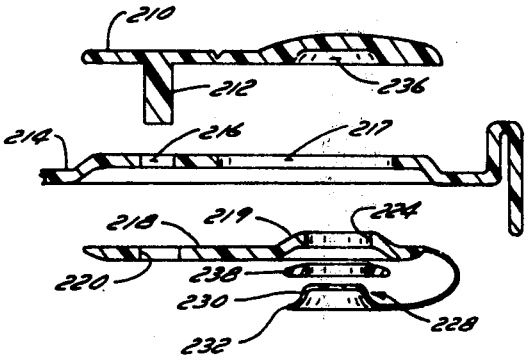
FIG. 15 is an exploded side sectional view of a further embodiment of a closure means for use with pressurized containers.
Figure 16:
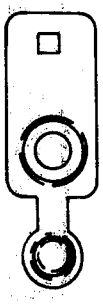
FIG. 16 is a top plan view of the inner closure tab illustrated in FIG. 15.
Figure 17:
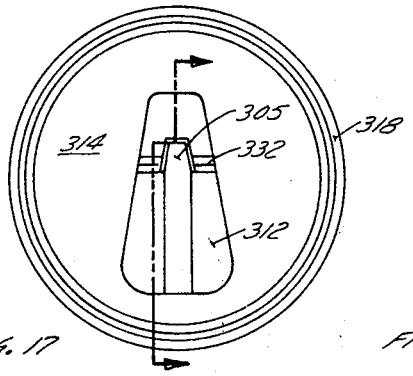
FIG. 17 is a top plan view of a further embodiment of the present invention wherein the pressure relief aperture is proximate the pivot point of the inner tab.
Figure 18:
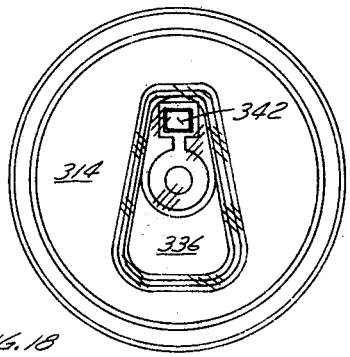
FIG. 18 is a bottom view thereof.
Figure 19:
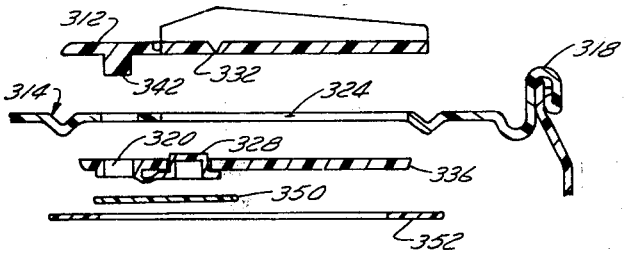
FIG. 19 is a side elevational view thereof showing the various components in a disassembled condition.
Figure 20:
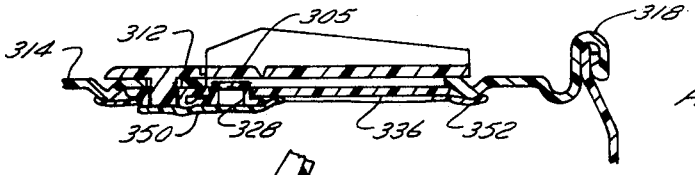
FIG. 20 is a cross-sectional view along the lines 20—20 of FIG. 17.

Turning to FIGS. 15 and 16, an embodiment similar to that of FIGS. 13 and 14 is shown. However, it will be noted that a bottom closure tab 218 has a raised land portion 219 surrounding pressure relief aperture 224. Furthermore, interposed between aperture sealing member 228 and aperture 224 is a gasket 238. A rupturable membrane may again be provided on the underside of tab 218 as previously discussed.

The closure means of FIGS. 15 and 16 will function similar to those aforedescribed and thus includes a gripping top closure tab 210 having a stud 212 integral therewith adapted to be received in apertures 216 of cover member 214 and 220 of bottom closure tab 218. A cavity 236 is likewise provided in top member 210.

Referring to FIGS. 17 to 21, the drawings illustrate a closure member according to the present invention wherein a further embodiment of a pressure relief aperture is provided. Thus, there is provided a closure member 314 having a peripheral rim 318 adapted to engage the side walls of a container. Within closure member 314 is an aperture 324 to permit a commodity such as a beverage to be discharged from the container.

An outer closure tab 312 is provided, the outer closure tab having one or more score lines 332 scored to a depth sufficient to permit a flexing of outer tab 312; it will be noted that scorelines 332 do not extend across the entire width of tab 312, but rather there is provided an intermediate portion where they do not extend thus providing a minor tab portion generally designated by reference numeral 305.

Apart from the provision of a minor tab portion 305, outer tab 312 is formed in a manner substantially identical to the previous described embodiments and thus includes a stud or ligament 342 of a rectangular configuration forming a portion of outer tab 312.

Inner tab 336 is similar to previously described embodiments and includes an aperture 320 adapted to receive stud 342. Also included in inner tab 336 is a pressure relief aperture proximate aperture 320, the pressure relief aperture being sealed by a pressure relief aperture closing member 328. A sealing membrane 350 is provided on the underside of inner tab 336 covering pressure relief aperture closing member 328 and sealing the same to inner tab member 336. A further rupturable membrane 352 is provided about inner tab 336 as in previously described embodiments.

Figure 21:
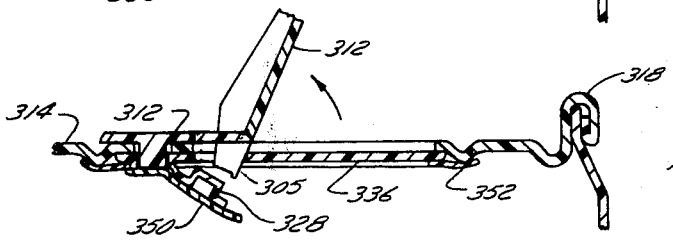
FIG. 21 is a cross-sectional view similar to FIG. 20 showing the opening of the cover.
Figure 22:
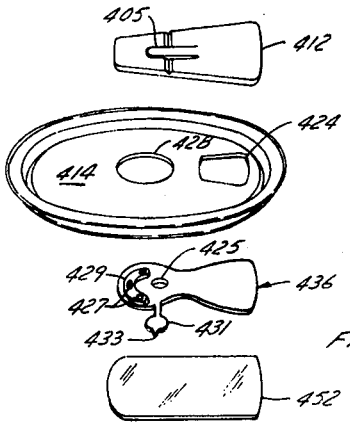
FIG. 22 is a is a perspective view of the disassembled components of a further embodiment of a closure means.
Figure 26:
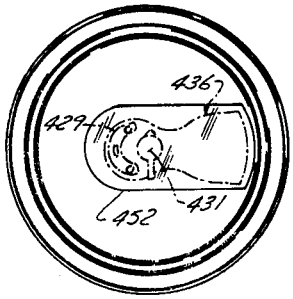
FIG. 26 is a bottom view of the assembled components of FIG. 24.
Figure 23:
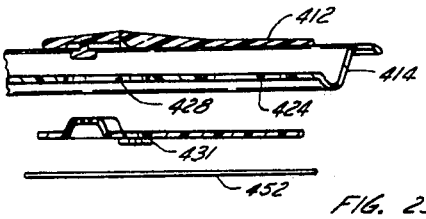
FIG. 23 is a cross-sectional view of the components of FIG. 22.
Figure 27:
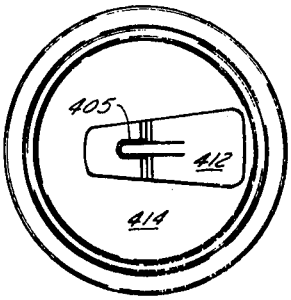
FIG. 27 is a top plan view of the assembled cover of FIG. 24.
Figure 24:
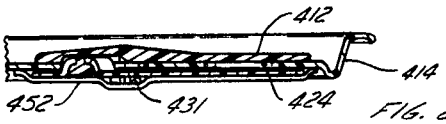
FIG. 24 is a cross-sectional view of the components of FIG. 22 in an assembled condition.

In operation, as illustrated in FIG. 21, a lifting or flexing of outer tab 312 about score lines 332 will cause minor tab portion 305, which is in registry with pressure relief aperture sealing member 328, to depress member 328 as shown in FIG. 21. This relieves the pressure within the container and then permits the depression of inner tab member 336 with a minimum of force. Otherwise, the closure means operates substantially as previously described. Preferably, the minor tab portion 305 is slightly raised such that when the outer tab 312 is flexed slightly upwardly, the minor tab portion 305 does not immediately contact pressure relief aperture sealing member 328. A substantial flexing movement is required to open member 328 such that when outer tab 312 is only flexed to a minor degree, minor tab 305 may still "clear" member 314.

The embodiment of FIGS. 22 to 27 is similar to embodiments previously described and thus reference herein will only be made to substantial differences therein. As will be seen from the drawings, member 414 has a first dispensing aperture 424 therein and a second aperture generally indicated by reference numeral 428.

Inner closure tab 436 includes a pressure-relief aperture 425 therein and in the illustrated embodiment, includes a plurality of apertures 427 in a raised land portion 429, which apertures 427 are adapted to receive mating pins or lugs in outer tab 412 in a manner substantially similar to that previously described. Inner closure tab 436 also includes a pressure relief aperture sealing member 431. Preferably, member 431 has a sharp or pointed portion 433 which is adapted to break or initiate tearing of sealing member 452 upon opening of the container.

Figure 25:
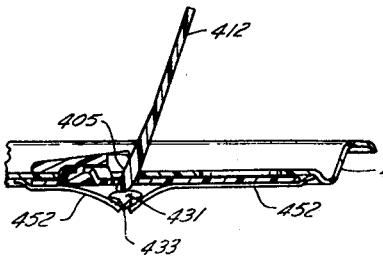
FIG. 25 is a cross-sectional view illustrating the operation of the embodiment of FIGS. 22 through 24.

Referring to FIG. 25, it will be seen that upon a lifting of finger-engaging portion of upper tab 412, a minor tab portion 405, which is in registry with pressure relief aperture sealing member 431, will depress the same. The edge or pointed portion 433 thereof will initiate a breaking or tearing action on sealing member 452 and relieve the pressure within the container.

In FIGS. 28 through 30, an embodiment similar to that illustrated in FIGS. 22 through 27 is shown. However, in this embodiment, no pressure relief aperture sealing member is employed. Rather, the aperture 525 is covered with a sealing member 552 which is of a sufficient strength to withstand any pressure within the container to be sealed. In this respect, sealing member 552 may comprise a plastisol member or alternately, may be a piece of suitable tape. To initiate the opening of the container, minor tab portion 505 of outer tab 514 may include a sharp or pointed edge 509 to cause an initial tearing or breaking of the sealing member 552.

It will be understood that various modifications may be made to the above-described embodiments without departing from the spirit and scope of the invention. Furthermore, it will be understood that conventional modifications may be made to the cover member such as, for example, the rolling over of all sharp and protruding edges to form rounded corners thereby minimizing any danger to the user. For example, where an aperture is formed in the cover member, it is known in the art to round the corner thereat.

I claim:

1. A container closure device comprising a closure member having a pair of opposed wall sections one of which is adapted to constitute an exterior wall section for said closure member and the other of which is adapted to constitute an interior wall section for the closure member, said closure member having a first aperture therein adapted to permit dispensing of a commodity from a container on which the closure member may be mounted, a second aperture in said closure member located in a spaced-apart operative relationship to said first-mentioned aperture, an outer closure tab adapted to surround and close said first-mentioned aperture on the exterior surface of said closure member, an inner closure tab adapted to be located in juxtaposition with the interior wall of said closure member, said inner closure tab having a body portion adapted to surround in closing relationship said first-mentioned aperture of said closure member, means for mounting said outer closure tab and said inner closure tab in spaced-apart fixed relationship to each other through said second aperture of said closure member for movement about a fixed axis, whereby said outer and inner closure tabs may be rotated about said fixed axis for bringing said closure tabs into and out of closing relationship with said first-mentioned aperture of said closure member.

2. A device as claimed in claim 1, wherein said closure member includes a recessed portion in the exterior surface of said closure member, and a raised land portion located within said recessed portion.

3. A device as claimed in claim 1, wherein said closure member includes on the interior surface thereof a raised land portion extending outwardly of the interior surface of said closure member, said raised portion including a recessed portion wherein said first-mentioned aperture of said closure member is located with said interior closure tab adapted to seat in said recessed portion in closing relationship with aperture therein.

4. A device as claimed in claim 1, wherein the apertures of said exterior and interior tabs are dimensioned to fixedly engage pivotably mounted means extending therebetween.

5. In a closure device for a container in which the closure member has a pair of opposed wall sections one of which is adapted to constitute an exterior wall section for said closure member and the other of which is adapted to constitute an interior wall section for the closure member, and with the closure member having a dispensing aperture therein adapted to permit dispensing of a commodity from a container on which the closure member may be mounted, the improvement wherein the closure member has an outer closure tab adapted to surround and close said closure member, an inner closure tab adapted to be located in juxtaposition with the interior wall of said closure member said inner closure tab having a body portion adapted to surround in closing relationship said dispensing aperture of said closure member and means for mounting said outer closure tab and said inner closure tab in spaced-apart fixed relationship to each other for movement about a fixed axis, whereby said outer and inner closure tabs may be rotated about said fixed axis for bringing said closure tabs into and out of closing relationship with said dispensing aperture of said closure member.

6. The device of claim 5, wherein said interior closure wall includes a rupturable sealing membrane surrounding said inner closure tab and wherein said inner closure tab may be depressed to rupture or displace said membrane from sealing engagement with said inner wall.

7. A device as defined in claim 5, wherein said means for mounting said outer closure tab and inner closure tab in said fixed relationship comprises means for rigidly and fixedly connecting said tabs together at a point spaced from said dispensing aperture, said last mentioned means extending through said closure wall.

8. The device of claim 6, wherein said membrane is of a type whereby upon rotation of said inner and outer closure tabs, said membrane is ruptured to permit contents of a container to be discharged through the dispensing aperture.

9. A device as defined in claim 7, wherein said closure member includes a recessed portion in the exterior surface of said closure member, and a raised land portion located within said recessed portion.

10. A device as defined in claim 7, wherein said closure member includes on the interior surface thereof a raised land portion extending outwardly of the interior surface of said closure member, said raised portion including a recessed portion wherein said aperture of said closure member is located with said interior closure tab adapted to seat in said recessed portion in closing relationship with aperture therein.

11. A device as defined in claim 7, wherein said inner closure tab is sufficiently flexible to permit the flexion outwardly from the interior surface of said closure member.

12. A device as defined in claim 7, wherein said outer closure tab is of a flexible material sufficient to permit said finger-engaging portion to be raised outwardly from said exterior wall section.

13. A device as defined in claim 7 wherein said inner closure tab includes a pressure relief aperture therein, said pressure relief aperture being adapted to be sealed by an aperture sealing member hingedly secured to said inner closure tab.

14. A device as defined in claim 13 wherein said outer closure tab has an interrupted line of weakening therein to permit flexing of the same, and a minor tab portion within said outer closure tab, said minor tab portion being in registry with said aperture sealing member hingedly secured to said inner closure tab.

15. A device as defined in claim 5, wherein said outer closure tab has a finger-engaging portion integral therewith.

16. A device as defined in claim 5, wherein said outer closure tab includes a projection extending therefrom adapted to extend through a second aperture in said closure member, said projection mating with said inner closure tab such that a rotation of the outer closure tab causes rotation of the inner closure tab.

17. A device as defined in claim 16, further including sealing means extending about said inner closure tab.

18. In an end wall closure suitable for use with a container for pressurized materials and wherein the end wall closure has a dispensing aperture and a closure device, the improvement wherein the closure device comprises inner and outer closure tabs sized to cover said dispensing aperture, means for mounting said inner and outer closure tabs in a fixed relationship on opposed sides of said end wall, said inner and outer closure tabs being rotatably mounted with respect to said end wall, a pressure relief aperture in said inner closure tab, and means for sealing said pressure relief aperture.

19. The closure device of claim 18, wherein said outer closure tab has a member projecting therefrom through a second aperture in said end wall and mating with an aperture in said inner closure tab to hold the inner and outer tabs in a fixed relationship, said aperture in said end wall being sized larger than said projection from said outer closure tab.

20. The device of claim 18, wherein said means for sealing said pressure relief aperture comprises a sealing member formed integrally with said inner closure tab.

21. The device of claim 20, wherein said outer closure tab has an interrupted line of weakening therein to permit flexing of the same, and a minor tab portion within said outer closure tab, said minor tab portion being in registry with said aperture sealing member and being adapted to open said aperture sealing member upon a lifting movement of said outer closure tab.

22. The closure device of claim 18, wherein said end closure wall and said inner closure tab are formed of a metallic material and said outer closure tab is formed of a plastic material.

23. The device of claim 19 wherein said pressure relief aperture is situated proximate to said means for mounting the inner and outer closure tabs in said fixed relationship.

* * * * *